US005964306A

United States Patent [19]

Barbera

[11] Patent Number: 5,964,306

[45] Date of Patent: Oct. 12, 1999

[54] AUGER EARTH BORING MACHINE WITH IMPROVED EFFICIENCY AND SAFETY

[76] Inventor: Leo J. Barbera, P.O. Box 145, Southern Pines, N.C. 28387

[21] Appl. No.: 09/033,579

[22] Filed: Mar. 3, 1998

[51] Int. Cl.[6] ..... E21B 3/06

[52] U.S. Cl. ..... 175/122; 175/171; 175/203

[58] Field of Search ..... 173/28, 46, 152; 175/122, 170, 171, 203, 62, 86

[56] References Cited

U.S. PATENT DOCUMENTS

| | | | |
|---|---|---|---|
| 3,870,279 | 3/1975 | Century | 175/122 X |
| 3,886,999 | 6/1975 | Appleman | 175/122 X |
| 3,910,358 | 10/1975 | Martinek | 175/122 X |
| 4,042,043 | 8/1977 | Appleman | 175/122 X |
| 4,090,736 | 5/1978 | Finney | 175/86 X |
| 5,014,795 | 5/1991 | Gibson | 175/45 |
| 5,361,854 | 11/1994 | Tull et al. | 175/45 |

*Primary Examiner*—Frank Tsay

*Attorney, Agent, or Firm*—Robert R. Reed; Cort Flint

[57] ABSTRACT

The boring machine is disclosed which includes a power and control unit having a power source which uses a large electrical motor, a large hydraulic pump and a torque convertor connected to a speed reducer which controls the speed and torque provided to the auger and cutting head. A second small electrical motor and small hydraulic pump are used to power two hydraulic cylinders for pushing the string of pipe casings into the bored hole using a master pusher. A structural protector frame provides safety protection for an operator seated within the power and control unit. A control console is used by the operator for operating and controlling the boring machine and the direction of the string of pipe casings in the bored hole. Steering and pipe control cables extend into the bored hole from a wire spool mounted on the front of the power and control unit. A generator power by a diesel engine located outside the pit area provides electrical power for the electrical motors. The result of this new power and control unit accomplishes the objectives of a safe and efficient boring machine and boring operation.

20 Claims, 7 Drawing Sheets

AUGER EARTH BORING MACHINE WITH IMPROVED EFFICIENCY AND SAFETY

BACKGROUND OF THE INVENTION

This invention relates to auger boring machines for forming a cased bore underground by boring and pushing casings in a generally horizontal direction from a pit area. In particular, the invention relates to a power and control unit of the boring machine which is efficient to operate and safe for an operator to use.

Earth boring machines are known which are slidably mounted and reciprocated longitudinally along a track in the pit area by means of a hydraulic piston assembly. The forward end of the boring machine has an auger which is rotated within the casings with the forward end of the auger having a cutting head for boring a hole in the earth. The cutting head bores the hole and the auger carries the dirt outward for ejection into the pit area. The hydraulic piston assembly forces the pipe casing through the bore as it is formed. Successive pipe casings are added to the string of pipe casings as the bore progresses. The generally horizontal direction of the string of pipe casings is normally controlled by an articulated steering head section located in front of a forward pipe casing. A power and control unit of the boring machine provides energy for the torque required to rotate the auger and the forces required for the hydraulic pistons to push the boring machine along the track. The power and control unit also provides the operator with a means to modulate or control the amount of energy supplied for rotating and pushing as well as for articulating the steering head.

Typical earth boring machines are disclosed in U.S. Pat. Nos. 3,767,836; 3,851,176; 3,939,926; 4,013,134; and 5,099,927. The boring machines of these references illustrate the basic components of typical boring machines common in the art. The machines are located in a pit area and each are operated by an operator from an exterior to the boring machine itself.

Support equipment located at the top edge of a pit area provides electrical and hydraulic power to support the boring machine within the pit area. The support equipment commonly includes electrical monitoring equipment for tracking the path of the string of pipe casings. Sensors associated with the forward end of the string of pipe casings generate tracking information which can be monitored and plotted for tracking the path of the string of pipe casings. Commonly used sensors include angular rate sensors, rate gyros and accelerometers with integrating circuits, water level gages and distance measuring devices. Some applications of these devices are discussed in U.S. Pat. No. 5,099,927.

Standard boring machines of the present time are built with a diesel or gas engine power unit driving a gear type transmissions connected to a gearbox or speed reducer. The engine produces a torque that drives the transmission that multiplies the torque output to be many times the engine torque. The transmission drives a speed reducer that multiplies the torque again by as much as 100 times. The boring machines vary in size from very small to very large. Some machines provide more than 100,000 foot-pounds of torque to an auger. A fundamental problem with diesel or gas engines is that the exhaust fumes fill the pit area and the air quality must be monitored. It is not uncommon for the workers in the pit area to be required to leave the pit area until the air quality has become safe.

When boring machines are drilling a horizontal bore, the earthen material being encountered at any given time is unknown. To unexpectedly bore into an impenetrable object of earthen material, there can be a violent and dangerous transfer of torque to the boring machine. Boring machine have been known to turn over in the pit area causing damage to the equipment and personal injury to the operator and others. For example, the reaction is similar to a common drill when boring through a wood object and hitting a piece of metal causing the drill's power unit to twist violently out of control in the operator's hand. A typical 36 inch diameter horizontal earth boring machine is manufactured as Model No. 36-600 by American Augers of Underground Technology, Inc. of Wooster, Ohio.

A platform is located on the side of the earth boring machines for the operator to use in accessing the controls that operate the boring machine. The platform is located either on the left side, the right side or on the rear of the boring machine. The operator leans over one side of the boring machine to access the controls, including the gear shift of the transmission. Any sudden movement of the machine can cause the operator to fall into the boring machine and make contact with moving and hot parts of the machine. This does occur frequently with operators which are not experienced.

A push bar is positioned between the two tracks of the standard boring machine to provide a surface for the hydraulic piston assembly to push against when advancing the pipe casings into the bored hole. When the piston assembly is energized the machine moves along the tracks for the length of the piston shaft extension. The push bar is then disengaged from the tracks and relocated to the next position along the tracks. This is repeated until a full section of pipe casing has been pushed into the bore. The nominal length of a pipe casing is 20 feet. The auger is then uncoupled from a drive line and the push bar is unlocked from the tracks. A hydraulic winch is provided at the rear of the boring machine having a cable to be hooked to the rear of the boring machine and activated to return the boring machine to its original starting position along the tracks. Another one of the dangers in operating the standard boring machine is associated with the cable of the winch becoming suddenly disconnected and whipping through the air in the pit area.

Machines that are operated from a rear platform usually have a manual foot-operated pedal for unlocking and relocating the push bar from the tracks. This arrangement further subjects the operator to dangers associated with being off-balance while operating the foot-operated petal. The push bar is located under this rear platform and has been a source of severe injury for the operators's feet.

After moving the boring machine to its starting position another section of pipe casing and another auger section is added to the pipe string and auger in the pit area. The push bar is also relocated to its initial position for the hydraulic piston assembly to again push against. The sequence described above is repeated until the full predetermined length of the bore has been cased with pipe casings and the forward pipe casing and the steering head section have been recovered.

Accordingly, an object of the present invention is to provide a power and control unit which may be personally operated in an earth boring machine pit area in a safe and reliable manner.

Another object of the present invention is to provide an earth boring power and control unit which reduces the possibility of a boring machine turning over in a pit area causing injury of death to an operator and others working in the pit area. Excessive torque capabilities that cause boring machines to turn over are reduced by replacing the commonly used diesel engine and placing the operator in a safe position protected by a structural protecting frame or cab.

Another object of the present invention is to provide a power and control unit which reduces the dangers associated with a hydraulic winch and cable used in the pit area for moving components in the pit area relative to each other prior to installing another pipe casing. This object is to further provide smooth safe hydraulic travel of the power unit on the track system in the pit area.

Yet another object of the present invention is to eliminate the danger associated with moving the push bar along the track system for adjusting the location of the push bar to allow pushing of the string of pipe casings to continue.

A further object is to eliminate exhaust fumes and noise levels in a pit area associated with the operation of diesel engines. A quiet power source capable of maintaining the proper environmental conditions is a part of this object.

SUMMARY OF THE INVENTION

The above objectives are accomplished according to the present invention by providing a power and control unit for a boring machine having a power source which uses a large electrical motor, a large hydraulic pump and a torque convertor connected to a speed reducer which controls the speed torque provided to the auger and cutting head. A second small electrical motor and small hydraulic pump are used to power two hydraulic cylinders for pushing the string of pipe casings into the bored hole using a master pusher. A structural protector frame provides safety protection for an operator seated within the power and control unit. A control console is used by the operator for operating and controlling the boring machine and the direction of the string of pipe casings in the bored hole. Steering and pipe control cables extend into the bored hole from a wire spool mounted on the front of the power and control unit. A generator power by a diesel engine located outside the pit area provides electrical power for the electrical motors. The result of this new power and control unit accomplishes the objectives of a safe and efficient boring machine and boring operation.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
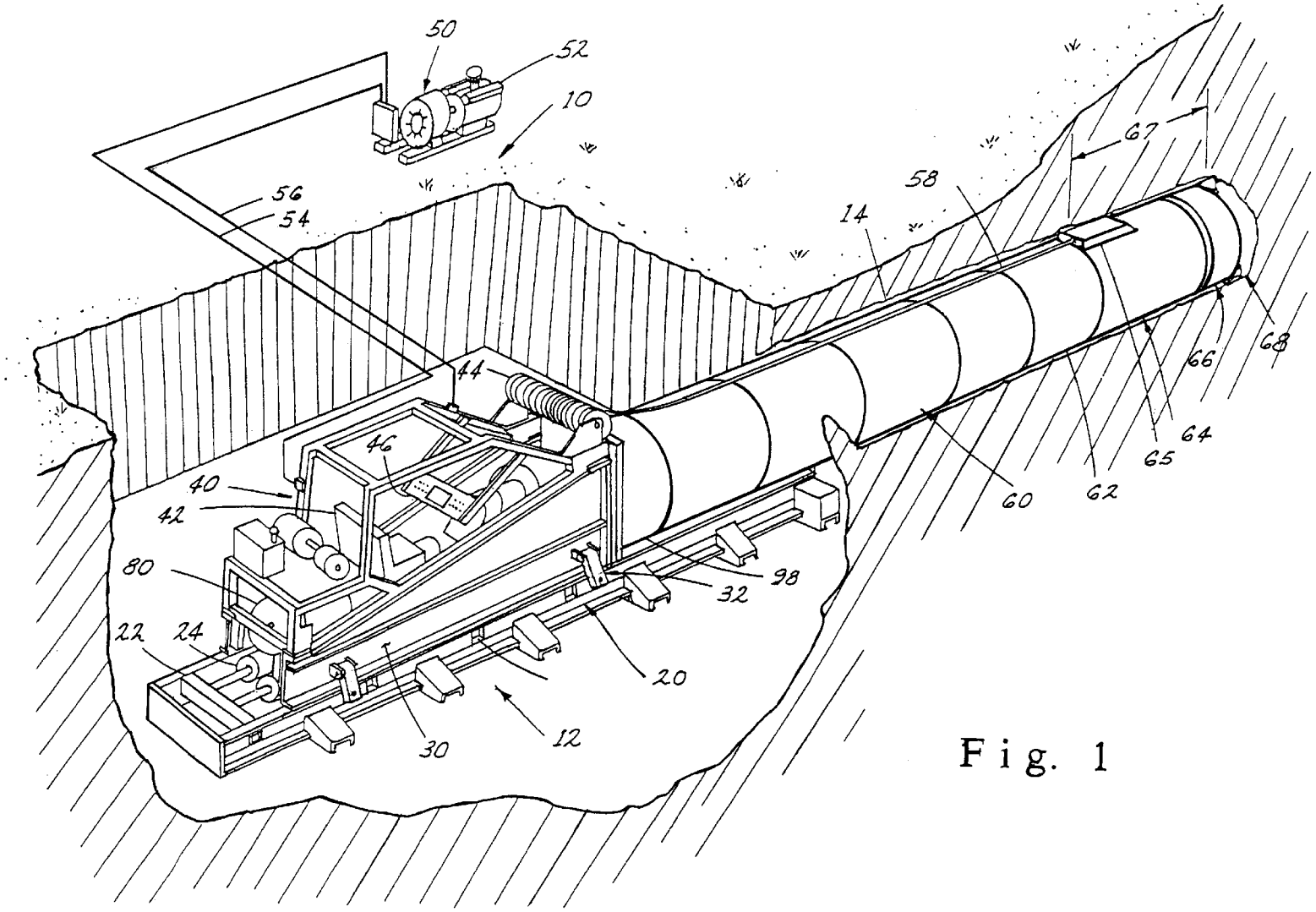
FIG. 1 is a perspective view of an earth boring machine having a power and control unit constructed in accordance with the present invention.

Referring now in more detail to the drawings, the invention will now be described in more detail. FIG. 1 illustrates a boring machine 12 installing a string of pipe casings 60 into a bored hole 14 from a pit area 10. The hole is bored by a cutting head 68 at the front of a steering head 66 rotatably supported at a forward pipe casing 64. Standard pipe casings 62 remain in the bored hole when the forward pipe casing reaches a terminal location. Pipe casings are installed one at a time by a master pusher 98 that pushes the string of pipe casings 60 into the bored hole. An auger is located within the pipe casings for removal of dirt from an opening in the master pusher. The auger is driven by an electric motor 80 powered by a generator 50 driven by an engine 52. The generator unit and engine are placed outside the pit area for safety reasons and a power cable 54 supplies power to the motor. Pushing cylinders 24 push the base unit 30 with respect to the track system 20 by pushing against a push bar 22 of the track system. The push bar is moved to a new push bar cutout 26 in the track system when the base unit has advanced far enough along the track system to allow the push bar to be moved. After successive moves the base unit is returned to its starting position along the track system and a new pipe casing is installed. Roller assemblies 32 allow the base unit to move with respect to the track system.

Control of the boring machine 12 is provided by a power and control unit 40 affixed to the base unit 30, as illustrated in FIG. 1. The power and control unit includes the electrical motor and additional components to be discussed in later sections of this description. An operator when located in a seat 42 of the power and control unit has access to a control console 46 for operating the boring machine. A control cable 56 from the generator unit supplies power for controlling the boring operation including the torque supplied to the auger, the forces supplied by the pushing cylinders and forces required to change the direction of the steering head. Guidance sensors are also energized from the control cable. A steering and pipe control cable 58 is coiled onto a wire spool 44 so that it can extend into the bored hole to operate a forward guidance section 67 of the string of pipe casings. The steering and pipe control cable enters the guidance section through an access structure 65 at the top of the string of pipe casings.

Figure 2:
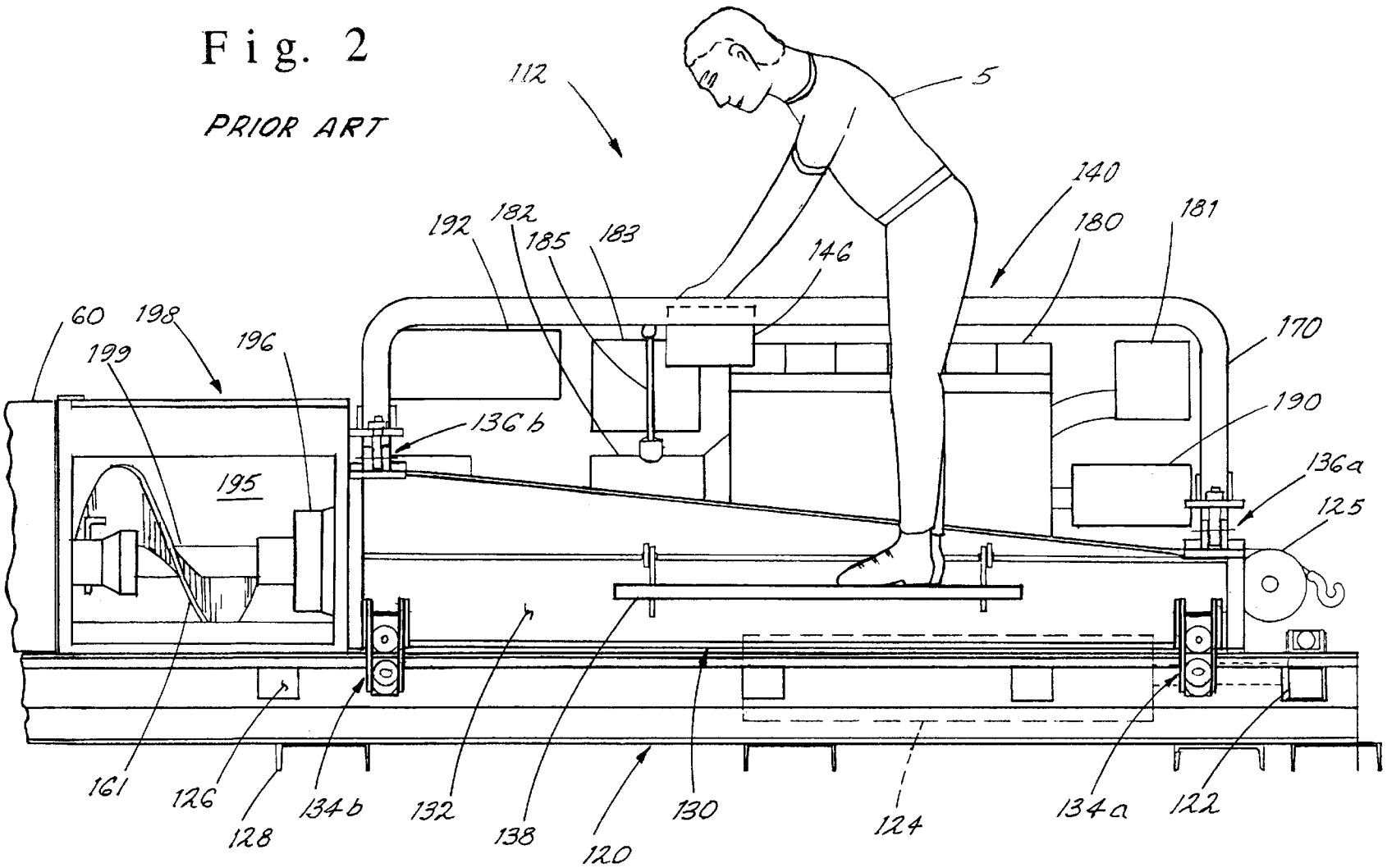
Fig. 2 PRIOR ART
FIG. 2 is a side elevation view of a prior art boring machine showing a track system supporting a movable base unit and power and control unit being operated from the exterior to the power and control unit.
Figure 3:
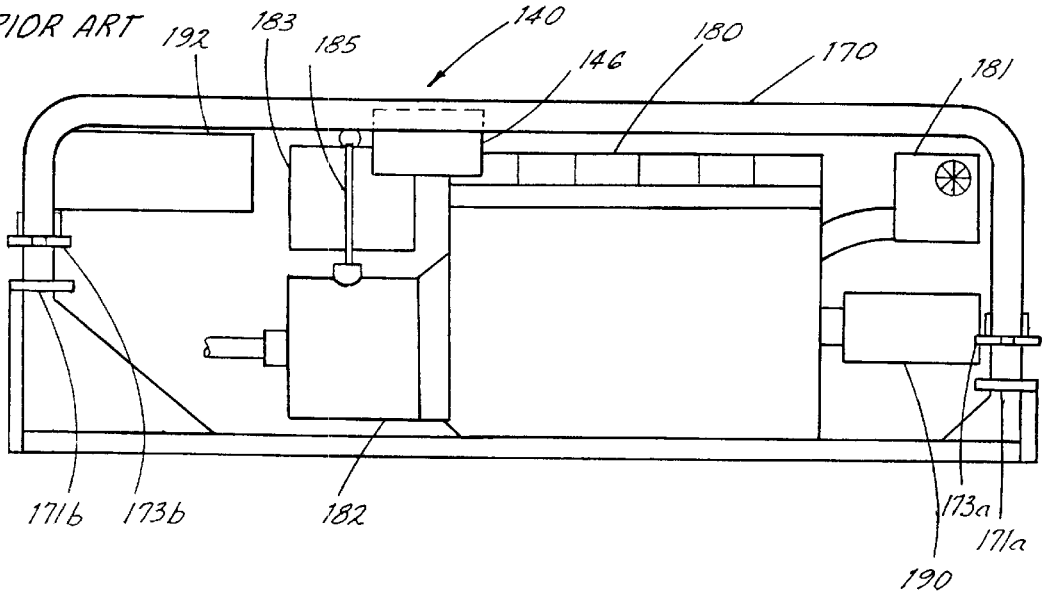
Fig. 3 PRIOR ART
FIG. 3 is a side elevation view of the power and control unit of FIG. 2 showing the components of the prior art power and control unit including a diesel engine power unit.
Figure 4:
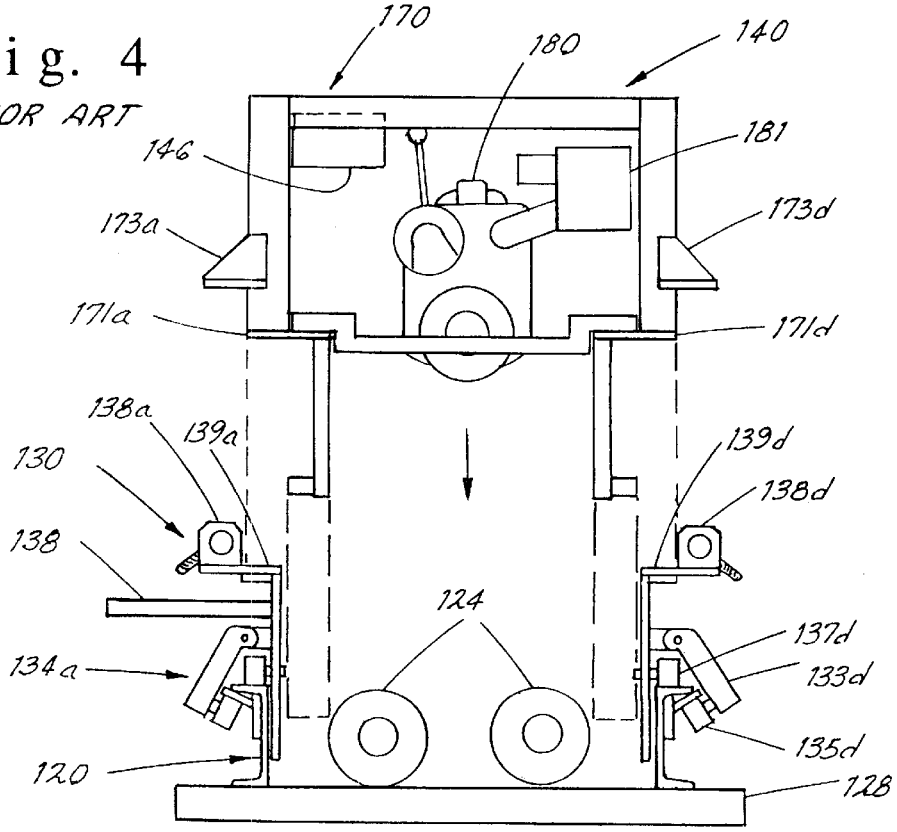
Fig. 4 PRIOR ART
FIG. 4 is an end elevation view of the prior art boring machine of FIG. 2 showing the power and control unit being lifted from the track system and base unit.

The boring machine of this invention uses some similar components as a prior art boring machine. Major changes have been in the referenced prior art earth boring machines as manufactured by American Augers of Underground Technology, Inc. of Wooster, Ohio. The boring machines of this reference are incorporated into this disclosure by reference thereto. Essential components of this reference are illustrated in FIGS. 2, 3 and 4 for further discussion. The operator 15 of this boring machine 112 stands on an operator platform 138 and bends over to access the control console 146 placed within a frame 170 of a power control unit 140. The operator platform is attached to a box frame 132 of the base unit 130. The power and control unit is attached to the base unit using attachment assemblies 136*a*–136*d* and moves with the base unit along the track system 120 using roller assemblies 134*a*–134*d*. Pushing cylinders 124 carried by the box frame act against a push bar 122 placed in one of the push bar cutouts 126 for forcing the string of pipe casings 60 into the bored hole 14. A hydraulic pump 190 driven by the diesel engine supplies hydraulic oil to activate the pushing cylinders 124. A master pusher 198 having a drive line 199 interfaces with an auger 161 and the string of pipe casings 60 to install the string of pipe casings in the bored hole 14. A hydraulic winch 125 attached to the base unit 130 is used to retract the base unit when installing a new pipe casing to the string. The auger effectively discharges dirt from the bored hole out the spoil opening 195 of the master pusher. Other components of the prior art power and control unit include a hydraulic oil tank 192 and an oil cooler 183 for providing a cooled supply of hydraulic fluid for the hydraulic pump 190.

The power and control unit 140 of the prior art boring machine is illustrated in FIGS. 3 and 4 as being removed from the base unit 130. Bearing plates 171*a*–171*d* of the power and control unit interface with base unit plates 139*a*–139*d* of the base unit when attachment brackets 173*a*–173*d* of the power and control unit are held by the connecting brackets 138*a*–138*d* of the base unit. Releasing the four connecting brackets from the attachment brackets allows the power control unit to be lifted from the base unit. The base unit 130 can is also removed from the track system by rotating the roller arms 133*a*–133*d* and lifting the base unit from the track system. The base unit is generally supported on the track system by support rollers 137*a*–137*d* and tipping rollers 135*a*–135*d*. Therefore, the boring machine is generally made with three separate parts being the power and support unit 140, the base unit 130 and the track system 120.

Figure 6:
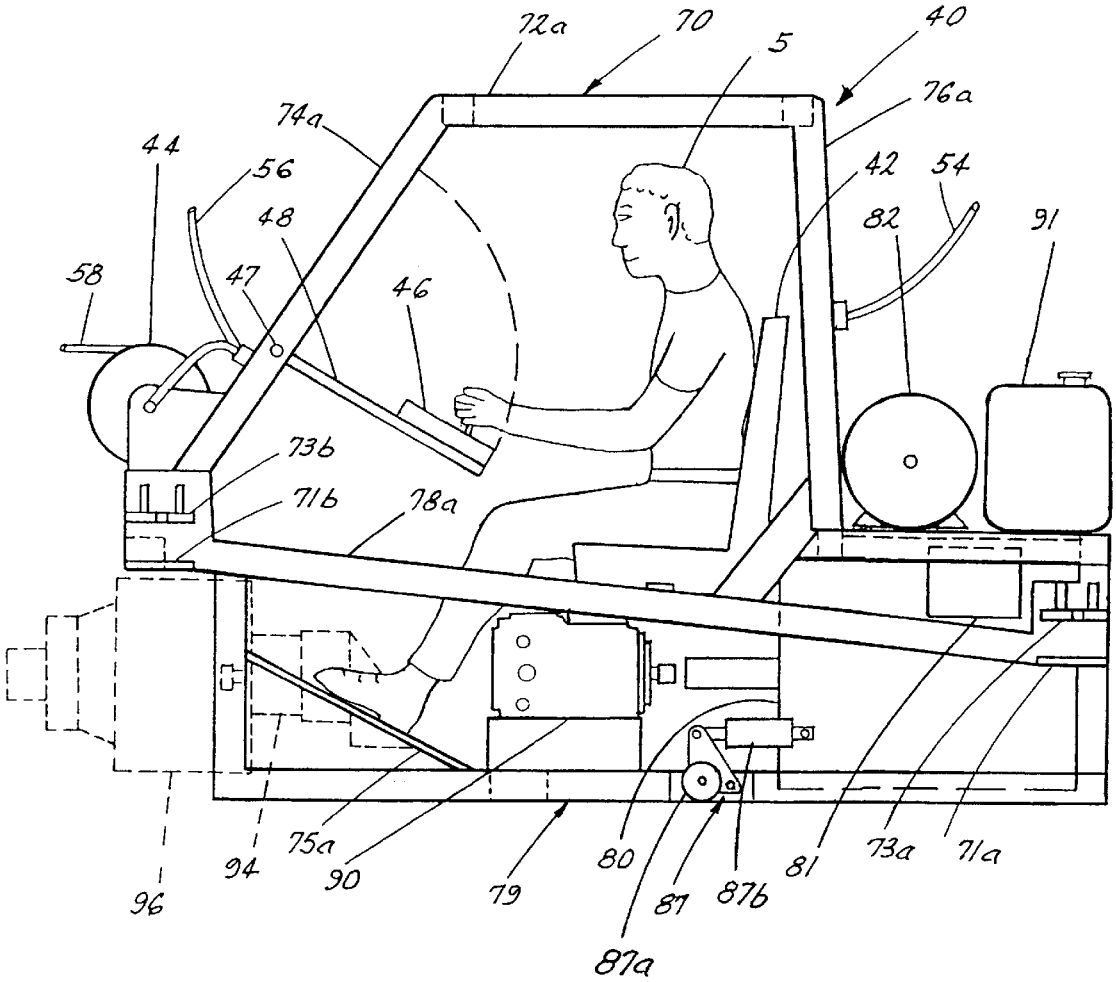
FIG. 6 is a side elevation view of the new power and control unit of this invention showing the components of the new power and control unit including two electrical motors as power units.

The present invention is primarily concerned with a completely new and novel power and control unit, as can best be seen by referring to FIG. 6. The components of the prior art power and control system including a frame 170, a diesel engine 180, an air intake 181 and a transmission 182 (FIG. 3) are replaced by the components of the power and control unit of this invention. The present invention is designed to control very critical safety problems with the prior art boring machines. For example, the prior art Model No. 36-600 with its diesel engine, transmission and speed reducer 196 can deliver a torque of about 50,000 foot pounds to the auger 161 when the transmission is in first gear. This torque is large enough to turn the boring machine over when the cutting head stalls during drilling operations.

Figure 5:
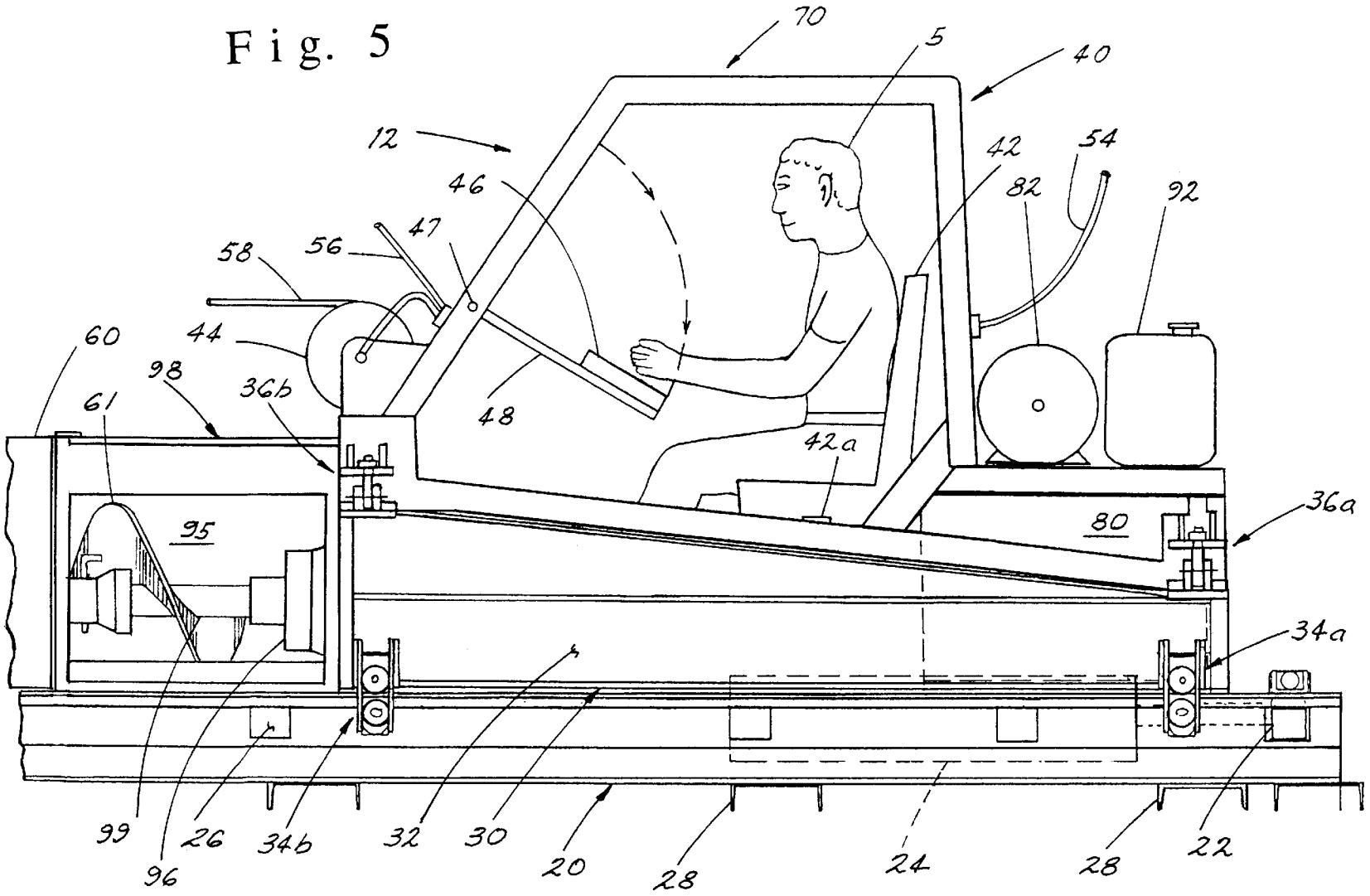
FIG. 5 is a side elevation view of the boring machine of this invention showing a track system supporting a movable base unit and a power and control unit constructed according to the invention which is operated from the interior of the power and control unit.

The power and control unit 40 of the present invention is used with a base unit 30 and track system 20 as illustrated in FIG. 5. The power and control unit is connected with the base unit using attachment assemblies 36*a*–36*d*. The power and control unit is shown removed from the base unit in FIG. 6. The operator 5 has an operator seat 42 inside a structural protector frame 70 to provide a safety shield for the operator in case the boring machine turns over during the boring operation. A control console 46 attached to console arms 48 pivots about console pivot pins 47 through the protector frame. The console provides access for the operator to monitoring and activating devices for controlling the boring machine. The control console rotates upward out of the way when not in use. Safe operation is assured by the design of the power and control unit of this invention. The console must be rotated down and the operator must be seated before the boring machine can be activated. A seat switch 42*a* verifies that the operator is seated.

Power for rotating the drive line 99 and auger 61 through a speed reducer 96 is provided by a first, large electrical motor 80 carried by the protector frame 70, as illustrated in FIGS. 5 and 6. The large electrical motor drives a large hydraulic pump 90 supplied by a hydraulic fluid storage 91 through hydraulic lines (not shown). The hydraulic pump is connected by additional hydraulic lines to a torque convertor 94 which in turn is rotatably attached to the speed reducer 96 for supplying torque to the drive line 96 an on to the auger 61 and cutting head 68. The pump and torque converter and speed reducer constitute a hydrostatic transmission. Instead of the torque converter and speed reducer, another suitable hydraulic motor may be used. A standard bypass arrangement in the torque convertor is used to limit the amount of maximum torque provided by the torque convertor to the speed reducer. Therefore, the danger in turning the boring machine over when the cutting head stalls is eliminated. For example, the large electric motor for a 36 inch bored hole is preferably about 60 horsepower to deliver about 40,00 foot pounds of torque to the drive line. An oil cooler 81 connected to the hydraulic lines keeps the hydraulic fluid cooled during the fluids use.

Figure 7:
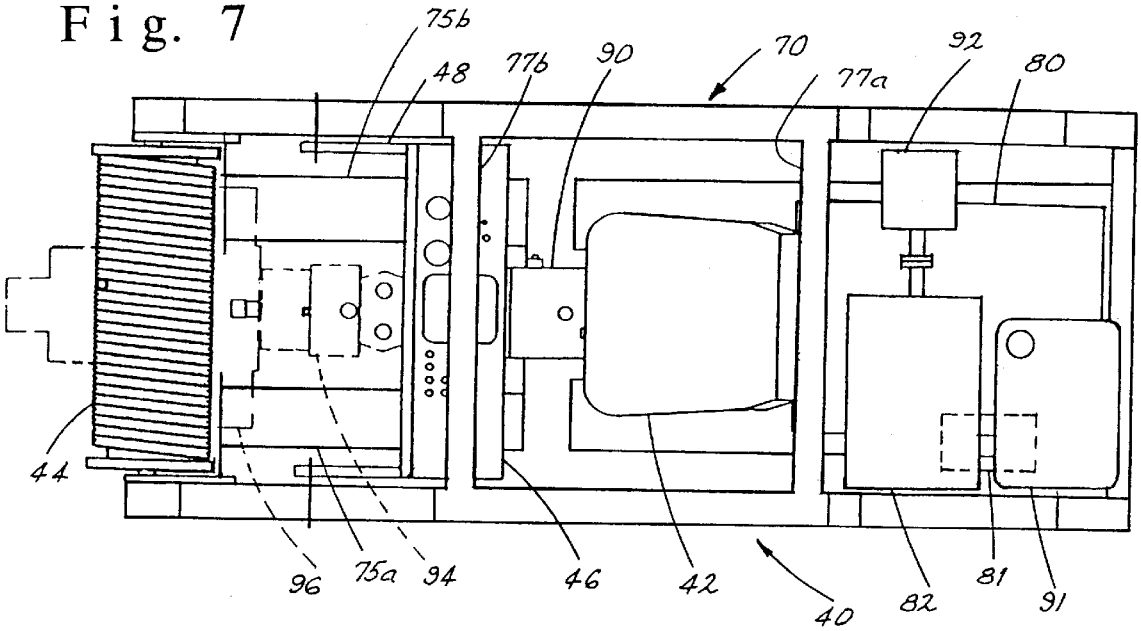
FIG. 7 is an top view of the power and control unit of this invention as illustrated in FIG. 6 again showing the components of the power and control unit of this invention interfacing with a torque convertor and speed reducer.

The power for the hydraulic pushing cylinders 24 is provided by a second, small electrical motor 82 driving a small hydraulic pump 92 (FIG. 7). Hydraulic lines (not shown) are connected to the pushing cylinders through controlled valves (not shown) for activating the pushing cylinders. Extending shafts of the pushing cylinders push against the push bar 22 for moving the power and control unit 40 along with the base unit 30 along the stationary track system 20 supported by the ground supports 28. For example, a small electric motor for a boring machine providing a commonly required 36 inch bored hole is preferably about 10 horsepower. The pushing cylinders 24 are carried by the box frame 32 of the base unit. Roller assemblies 34*a*–34*d* provide easy translational movement of the base unit and roller means to keep the base unit from tipping over when the cutting head 68 becomes stalled in the bored hole 14 (FIG. 1). The push bar 22 is moved to successive locations of push bar cutouts 26 as the boring and pushing operation continues. A drive assembly 87 retrieves the power and control unit along with the base unit to an initial position on the track system for installing a new pipe casing ahead of the master pusher in the pit area. The drive assembly includes an auxiliary wheeled drive 87*a* on each side of the track which may be selectively engaged by a hydraulic cylinder 87*b* between the mobile power and control unit and track to move the mobile unit in a reverse direction opposite the forward direction so that an additional pipe casing may be attached to said casing string and pushed through said bore. Wheel 87*a* may be driven by a suitable hydraulic motor (not shown) which may be supplied hydraulic fluid from pump 92. Alternately, the power and control unit may be returned by providing cylinders 24 as double acting cylinder arrangements. This drive assembly eliminates the danger of the prior art cable under tension for retrieving the power and control unit along with the base unit in the pit area. The loose dirt of the boring operation is removed through a spoil opening 95 in the master pusher 98.

Horizontal and vertical control of the string of pipe casings is provided by steering and pipe control cables 58 extending from power and control unit to the forward section 67 (FIG. 1) of the string of pipe casings. A wire spool 44 carried by the structural protector frame 70 contains the coiled steering and pipe control cables, as illustrated in FIGS. 5 and 6. The wire spool allows the distance between the power and control unit and the forward section to change during boring. It is not necessary to disconnect the steering and pipe control cables when a new pipe casing is being added. This feature of the present invention also increases the safety in operating the boring machine 12.

Figure 8:
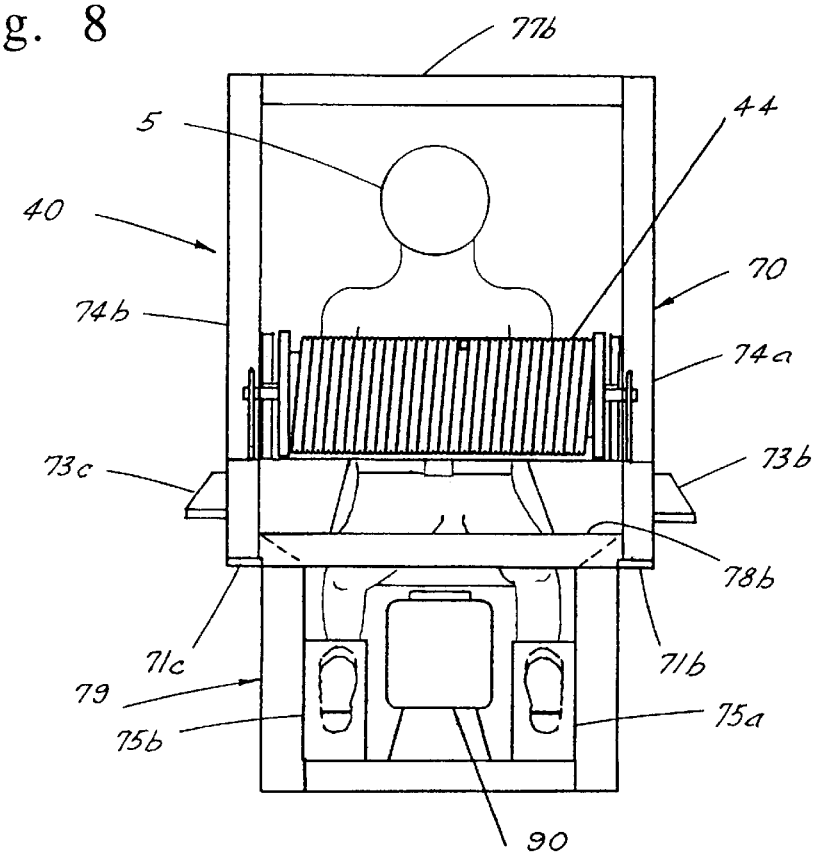
FIG. 8 is a front end view of the power and control unit of FIG. 7 showing the operator' view over a wire spool and foot plates for the operator's feet.
Figure 9:
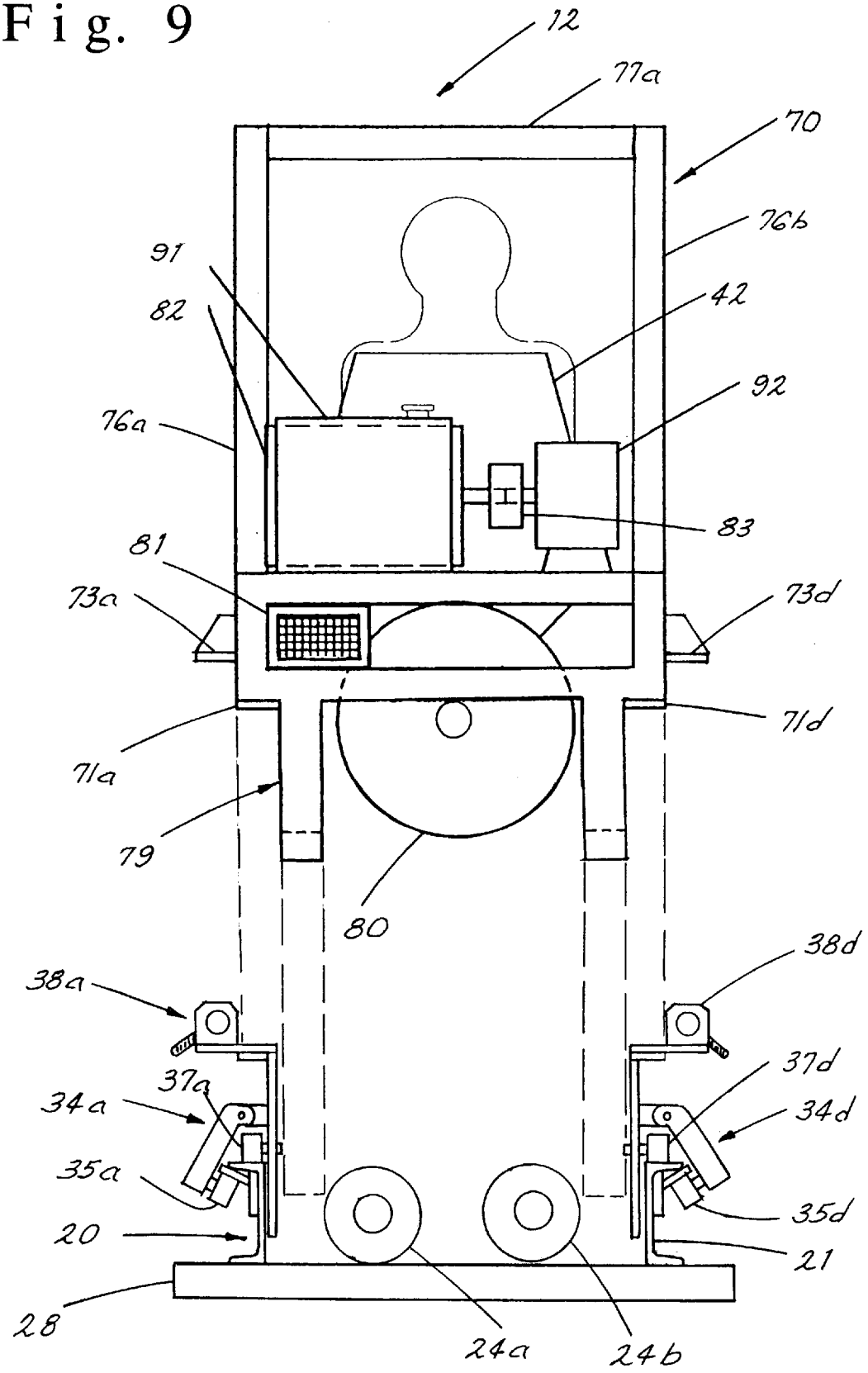
FIG. 9 is a rear elevation view of the power and control unit of FIG. 5 showing the power and control unit being lifted from the track system and base unit.

Additional structural and functional features of the power and control unit of this invention are apparent in the illustrations of FIGS. 7, 8 and 9. The top view of FIG. 7 shows the small electric motor 82 directly coupled to the small hydraulic pump 92 located to the rear of the seat 42 occupied by an operator. The hydraulic storage tank 91 is preferably located behind the small electrical motor. Foot plates 75*a* and 75*b* are located one on each side of the torque convertor 94. The operator's legs straddle the large hydraulic pump 90 located below the seat of this preferred design of the power and control unit 40. The operator is positioned to allow visual contact with the pipe casing over the wire spool 44 as the pipe casing is being pushed into the bored hole. Direct visual and hand contact with the control console 46 is provided for easy monitoring and control operations.

The structural protector frame 70 has a plurality of structural members as illustrated in FIGS. 6–9. Front members 74*a* and 74*b* are on each side to the front of the operator 5 for supporting the control console 46 as well as the wire spool 44. Rear members 76*a* and 76*b* are on each side behind the operator. Front and rear members along with top members 72*a* and 72*b* and cross members 77*a* and 77*b* form a protective cage for the operator 5. Support members 78*a* and 78*b* along with the bearing plates 71*a*–71*d* interface with the base unit to support the power and control unit on the box frame 32 of the base unit 30. Attachment brackets 73*a*–73*d* interface with connecting brackets 71*a*–71*d* to hold the power and control unit attached to the base unit at four locations. Bottom members 79 provide a means for making a generally rigid protector frame 70 and for supporting the electrical motors 80 and 82 and the hydraulic pumps 90 and 92 of this invention. Additional components supported by the protector frame include the oil cooler 81 as well as the hydraulic lines and electrical cables interconnecting the various components of the boring machine. Other arrangements and designs of the protector frame 70 and attachment assemblies 36*a*–36*d* are within the scope of this invention for providing protection to an operator, for attaching the power and control unit to the base unit and for supporting the mechanical and electrical components of the power and control unit.

In an alternate embodiment operator and control console of the boring machine can be relocated to be removed from the boring machine in the pit area. The seat for the operator is eliminated and the protector frame is modified to protect the mechanical and electrical components remaining with the boring machine in the pit area. The mechanical components remain with the power and control unit including the two electrical motors and the two hydraulic pumps. The torque convertor and the pushing cylinders remain with the base unit and the master pusher. The operator with the control console remains near the pit area for maintaining visual contact with the boring operation being provided by the boring machine. The advantage with this embodiment is that personnel in the pit area can be eliminated, except when adding a new pipe casing and auger section.

The advantages of the boring machine of this invention can be summarized as follows:

1. The boring machine of the present invention reduces or eliminates the roll-over problems of the prior art boring machines having a diesel engine power source. The torque convertor has a pressure override or bypass to limit the amount of torque provided to the drive line during boring operations.
2. The power and control unit of this invention reduces the environmental problems associated with the noise and exhaust fumes in the pit area by providing electrical motors and hydraulic pumps to drive the boring machine. An electrical generator with its drive motor are located remote from the pit area and only electrical power is provided to the pit area.
3. The structural protecting frame provides a plurality of members forming an operator protecting cab to allow the operator to be seated when accessing the control console. The safe operation of the boring machine by the operator is further enhanced by providing a drive assembly to return the power and control unit to its starting position before adding a new pipe casing.

While a preferred embodiment of the invention has been described using specific terms, such description is for illustrative purposes only, and it is to be understood that changes and variations may be made without departing from the spirit or scope of the following claims.

What is claimed is:

1. A boring machine for placing a string of pipe casings into a bored hole from a pit area, said boring machine including a cutter head carried by a leading end of said pipe casings, and a drive line for rotating a cutter head, wherein said boring machine comprises:

a track system disposed in said pit area;

a mobile power and control unit carried for reciprocal movement on said track system;

a protective cab included in said mobile power and control unit for protecting an operator in a seated position, said protective cab having an operator seat for accomodating said operator in said seated postion;

at least one hydraulic pushing cylinder for pushing said power and control unit along said track system and for advancing said string of pipe casings through said bored hole;

a control console for controlling the operation of said machine located in said cab for access and operation by said operator;

a first drive unit carried by said power and control unit for rotating said drive line to drive said cutter head;

a hydraulic torque limiter coupled with said first drive unit for controlling a torque applied to said drive line and reducing the likelihood of accidental roll over of said mobile unit; and a second drive unit for moving said mobile power and control unit forward on said track to push said string of pipe casings through said bored hole.

2. The machine set forth in claim 1 including a base unit connected to said second drive unit to provide said forward movement of both said power and control unit and said base unit along said track system, said power and control unit being carried by said base unit.

3. The machine set forth in claim 1 wherein said operator protective cab of said power and control unit includes an overhead structural protecting frame so that said operator seated within said frame is protected from harm.

4. The machine set forth in claim 3 wherein said overhead protecting frame includes side frame members extending forward and rearward of said operator seat and at least one overhead frame member extending between said side frame members.

5. The machine of claim 3 including a seat switch operatively associated with said operator seat that must be activated before said power and control unit can be operated, and said seat switch being activated by the presence of said operator in said seat.

6. The machine set forth in claim 1 wherein said first power unit includes a first electrical motor for driving a hydraulic pump, a torque convertor connected to said hydraulic pump which includes said torque limiter for limiting a maximum torque to said cutter head.

7. The machine of claim 6 wherein said first drive unit includes a speed reducer connected between said torque converter and said drive line.

8. The machine of claim 6 including an internal combustion engine disposed outside of said pit area for driving a generator form supplying electrial energy to drive said first electrical motor.

9. The machine set forth in claim 6 wherein said second drive unit includes a second electric motor driving a second hydraulic pump to actuate said at least one pushing cylinder so that said string of pipe casings are moved forward into said bored hole.

10. The machine of claim 1 including an auxiliary drive which may be selectively engaged between said mobile power and control unit and said track system for moving said mobile unit in a reverse direction opposite said forward direction so that an additional pipe casing may be attached to said casing string and pushed through said bore.

11. A boring machine for placing a string of pipe casings into a bored hole, said machine including a rotating cutter head carried by a leading end of said pipe casings being assembled and pushed through said bore from a pit area, and a drive line for rotating said cutter head, wherein said boring machine comprises:

a track system disposed in said pit area;

a mobile power and control unit carried for movement on said track system;

a control console having controls for operating said power and control unit for access and operation by an operator;

at least a one hydraulic pushing cylinder operatively connected with said power and control unit for advancing said power and conrol unit and said string of pipe casings through said bored hole;

a torque convertor for rotating said drive line and controlling a torque applied to said drive line;

a first hydraulic pump operatively connected to said torque converter for supply hydraulic fluid to said torque converter; and a first electric motor carried by said power and control unit for rotating said drive line to activate at least said cutter head; and a power source disposed outside of said power and contro unit area for operating said first electrical motor.

12. The machine of claim 11 including a second hydraulic pump carried by said mobile power and control unit for energizing said at least one hydraulic pushing cylinder to push said string of pipe casings through said bored hole.

13. The machine of claim 12 including a second electical motor carried by said power and conrol unit for driving said second hydraulic pump, and said power source operating said second electrical motor.

14. The machine of claim 13 wherein said power source includes an internal combustion engine disposed outside said pit area.

15. The machine of claim 11 wherein said power source includes an internal combustion engine disposed outside said pit area.

16. The machine set forth in claim 13 including a protective cab included in said said power and control unit for protecting an operator seated in an operator seat in said cab, said cab having an overhead structural protecting frame so that said operator seated within said frame is protected from harm.

17. The machine set forth in claim 16 wherein said overhead protecting frame includes side frame members extending forward and rearward of said operator seat and at least one overhead frame member extending between said side frame members.

18. The machine of claim 17 including a seat switch operatively associated with said operator seat that must be activated before said power and control unit can be operated, and said seat switch being activated by the presence of said operator in said seat.

19. The machine of claim 11 including a speed reducer connected between said torque converter and said drive line.

20. The machine of claim 11 including an auxiliary drive which may be selectively engaged between said mobile power and control unit and said track system for moving said mobile unit in a reverse direction opposite said forward direction so that an additional pipe casing may be attached to said casing string and pushed through said bore.

* * * * *